US007341485B2

(12) United States Patent
Polnyi

(10) Patent No.: US 7,341,485 B2
(45) Date of Patent: Mar. 11, 2008

(54) LAND GRID ARRAY SOCKET

(75) Inventor: Igor Polnyi, Aurora, IL (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/492,149

(22) Filed: Jul. 24, 2006

(65) Prior Publication Data

US 2008/0020638 A1 Jan. 24, 2008

(51) Int. Cl.
*H01R 13/40* (2006.01)

(52) U.S. Cl. ..... 439/591; 439/66; 439/862

(58) Field of Classification Search ..... 439/591, 439/66, 630, 180, 862, 885, 733.1, 747, 637, 439/833, 515, 908
See application file for complete search history.

(56) References Cited

U.S. PATENT DOCUMENTS 6,113,440 A * 9/2000 Fijten et al. ..... 439/862
6,454,607 B2 * 9/2002 Bricaud ..... 439/630
7,037,113 B2 * 5/2006 Soh ..... 439/66
7,052,284 B2 * 5/2006 Liao et al. ..... 439/66
2006/0035484 A1 * 2/2006 Hsu ..... 439/66

* cited by examiner

*Primary Examiner*—Edwin A. Leon
(74) *Attorney, Agent, or Firm*—Wei Te Chung

(57) ABSTRACT

An electrical connector (10) includes a dielectric housing (20) defining a number of passages (204) and a number of conductive terminals (30) received in corresponding passages, respectively. Each terminal includes a base section (300) secured in the passage and a pair of opposing resilient arms (302) projecting obliquely from upper and lower sides of the base section for electrical engagement with two electrical interfaces (40,50). Each resilient arm is integrally formed with a rib (308), and the ribs mate with each other under compression of the electrical interfaces, so as to provide a short electrical path.

14 Claims, 5 Drawing Sheets

LAND GRID ARRAY SOCKET

BACKGROUND OF THE INVENTION

1. Field of the Invention

The present invention generally relates to the field of electrical connectors. And more particularly, one embodiment of the present invention relates to a land grid array socket for forming reliable electrical connection between two electrical interfaces, such as a land grid array package and a circuit substrate.

2. General Background

Land grid array sockets are widely used to form electrical connection between two separate electrical surfaces, such as a land grid array package and a circuit substrate. A land grid array socket typically includes an electrically dielectric housing defining a number of passages and a number of conductive terminals received in the corresponding passages, respectively. Each conductive terminal includes a base section retained in the passage and a pair of resilient arms sticking obliquely from upper and lower sides of the base section to mate with two electrical interfaces. Under compression of the electrical interfaces, the resilient arms of the conductive terminal are deflected from their natural positions and abut against the electrical interfaces, thereby providing an electrical path between the electrical interfaces.

The material set forth in connection with this U.S. patent application describe a land grid array socket and associated conductive terminal—see e.g., U.S. Pat. No. 6,843,659, which is hereby incorporated by reference.

However, in the prior design, there is only one contacting point disposed on each resilient arm. When the conductive terminal is biased from its normal position in the housing, electrical interconnection between the land grid array package and the circuit substrate possibly cannot be ensured.

Therefore, there is a heretofore unaddressed need in the industry to address the aforementioned deficiencies and inadequacies.

SUMMARY

According to an embodiment of the present invention, a land grid array socket includes a dielectric housing defining a number of passages arranged in a predetermined fashion and a number of conductive terminals accommodated in corresponding passages, respectively. Each terminal includes a vertical base section secured in the passage and a pair of opposing resilient arms protruding obliquely beyond the housing from upper and lower sides of the base section. The resilient arms each define multiple convex contacting points at a free end thereof, so as to form reliable electrical connection with an electronic component coupled thereto.

The conductive terminal of the land grid array socket in accordance with the embodiment of the present invention includes a number of resilient arms each defining multiple contacting points at a free end thereof, which can ensure desirable electrical connection between the conductive terminal and an electronic component coupled thereto, even though the conductive terminal may be biased from its normal position.

The present invention is illustrated by way of example and not limitation in the figures of the appended drawings, in which like references indicate identical elements, and in which:

DETAILED DESCRIPTION OF THE EMBODIMENT

In the following description, for purpose of explanation, numerous details are set forth in order to provide a thorough understanding of the embodiment of the present invention. However, it will be apparent to one skilled in the art that these specific details are not required in order to practice the embodiment of the present invention.

Figure 1:
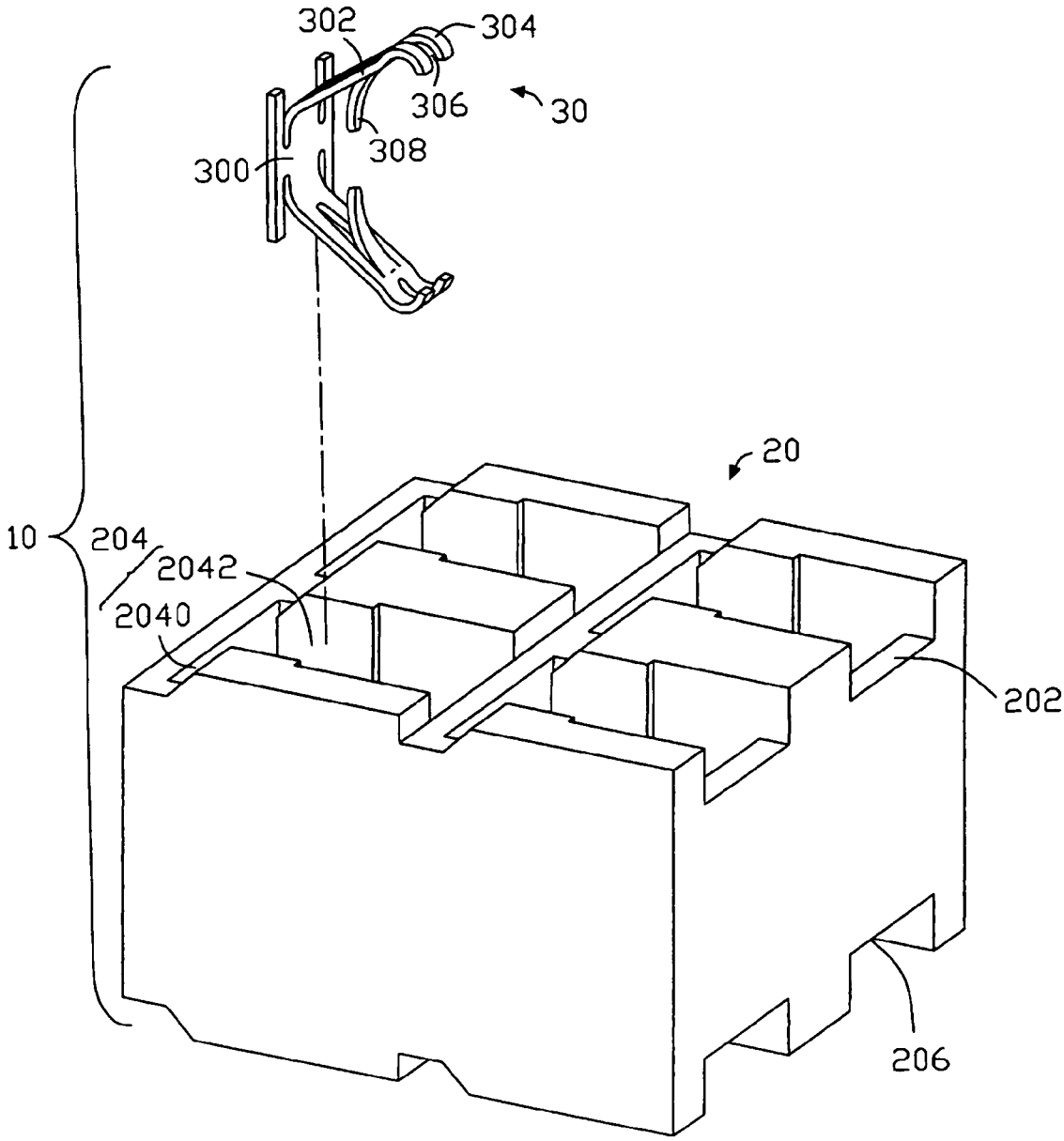
FIG. 1 illustrates an exemplary exploded view of a land grid array socket in accordance with an embodiment of the present invention, to put it simple, only part of the land grid array socket is illustrated.
Figure 2:
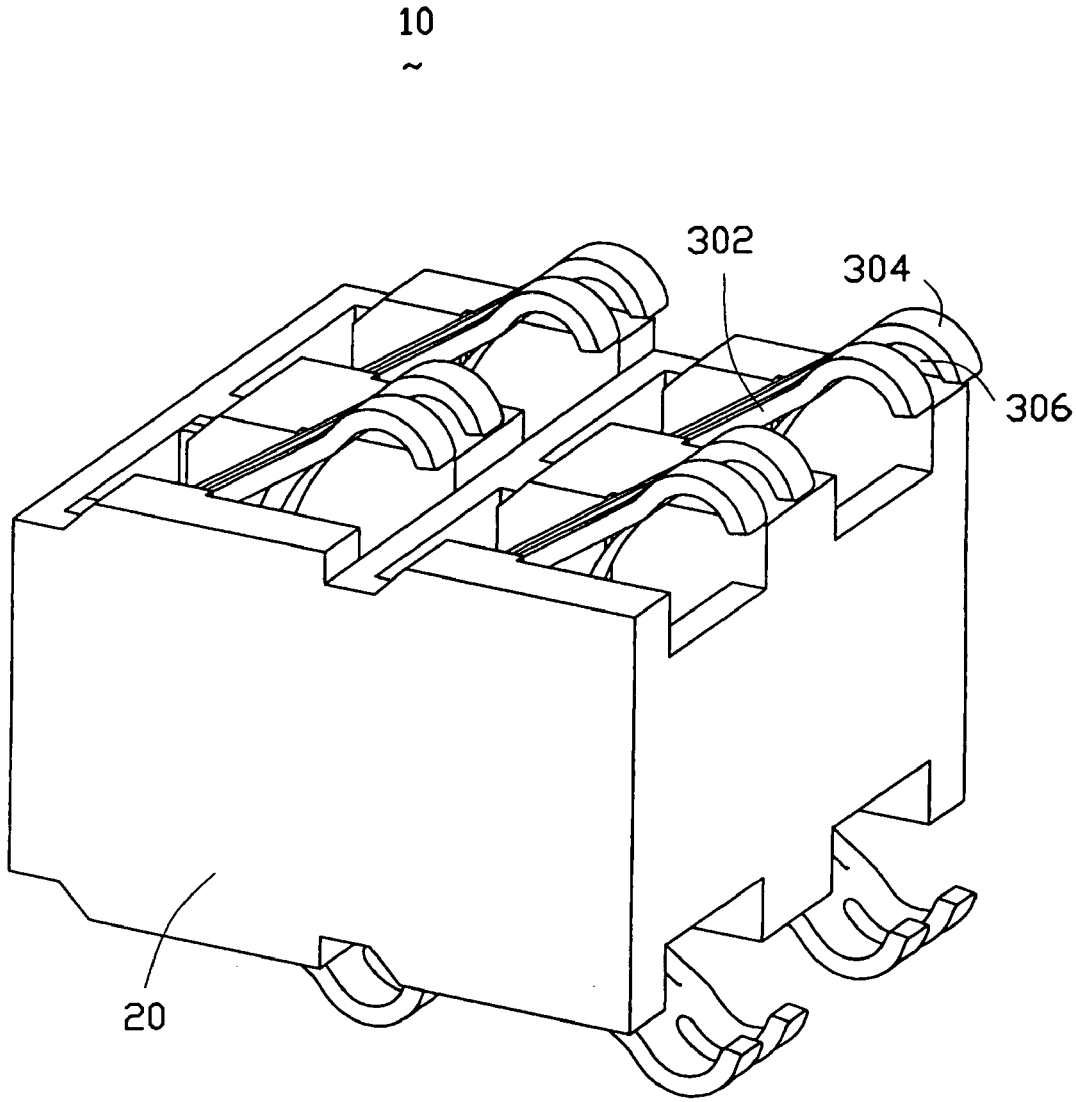
FIG. 2 illustrates an exemplary assembled view of the land grid array socket of FIG. 1.
Figure 3:
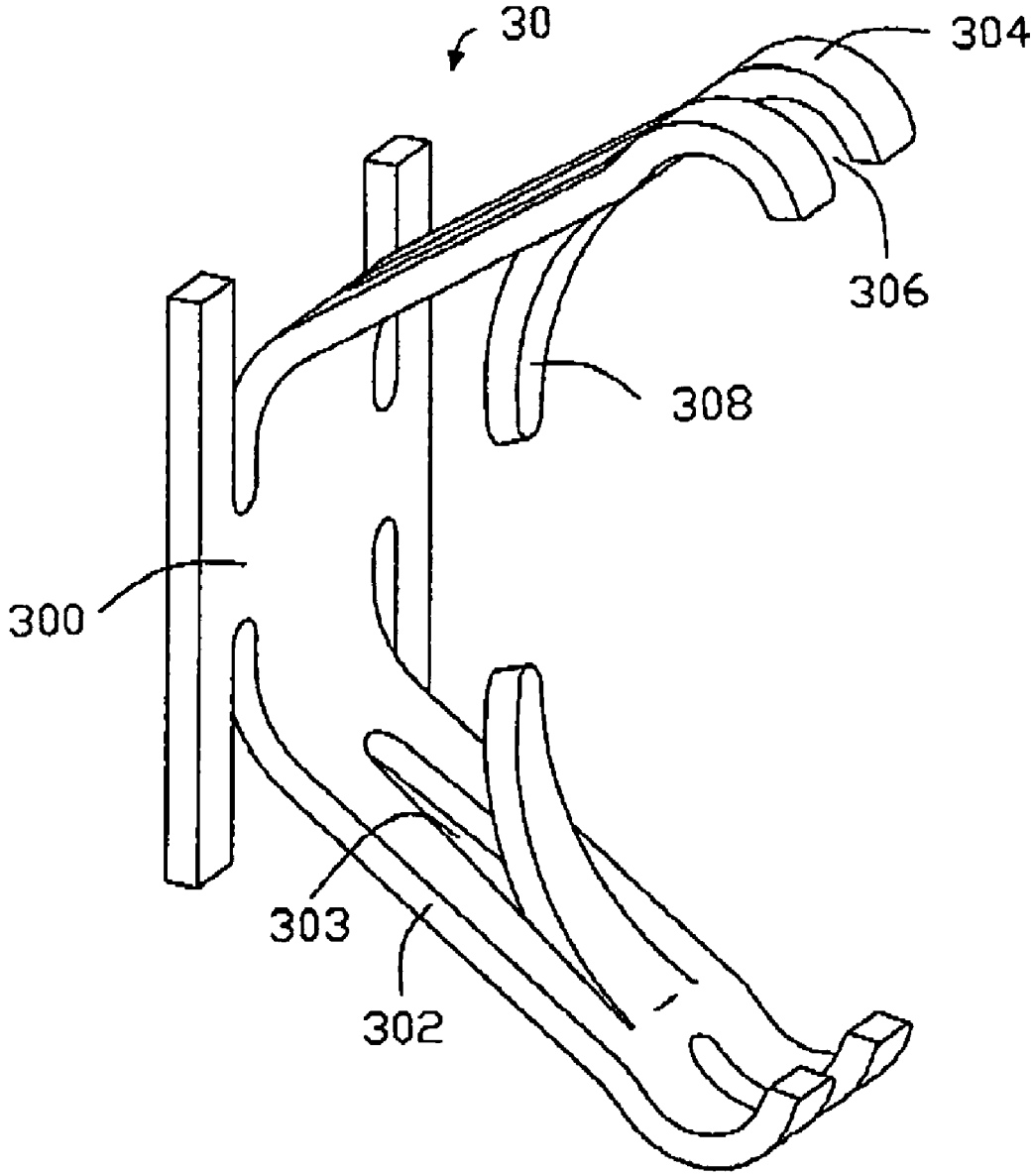
FIG. 3 illustrates an exemplary isometric view of a conductive terminal shown in FIG. 1.

Referring to FIG. 1 to FIG. 3, a land grid array socket 10 in accordance with an embodiment of the present invention includes a dielectric housing 20 having a number of passages 204 and a number of conductive terminals 30 seated in corresponding passages 204, respectively. Each terminal 30 includes a base section 300 secured in the passage 204 and a pair of opposing resilient arms 302 protruding obliquely beyond the housing 20 from upper and lower sides of the base section 300. The resilient arms 302 each define multiple convex contacting points 304 at a free end thereof to mate with a land grid array package 40 or a circuit substrate 50.

Figure 4:
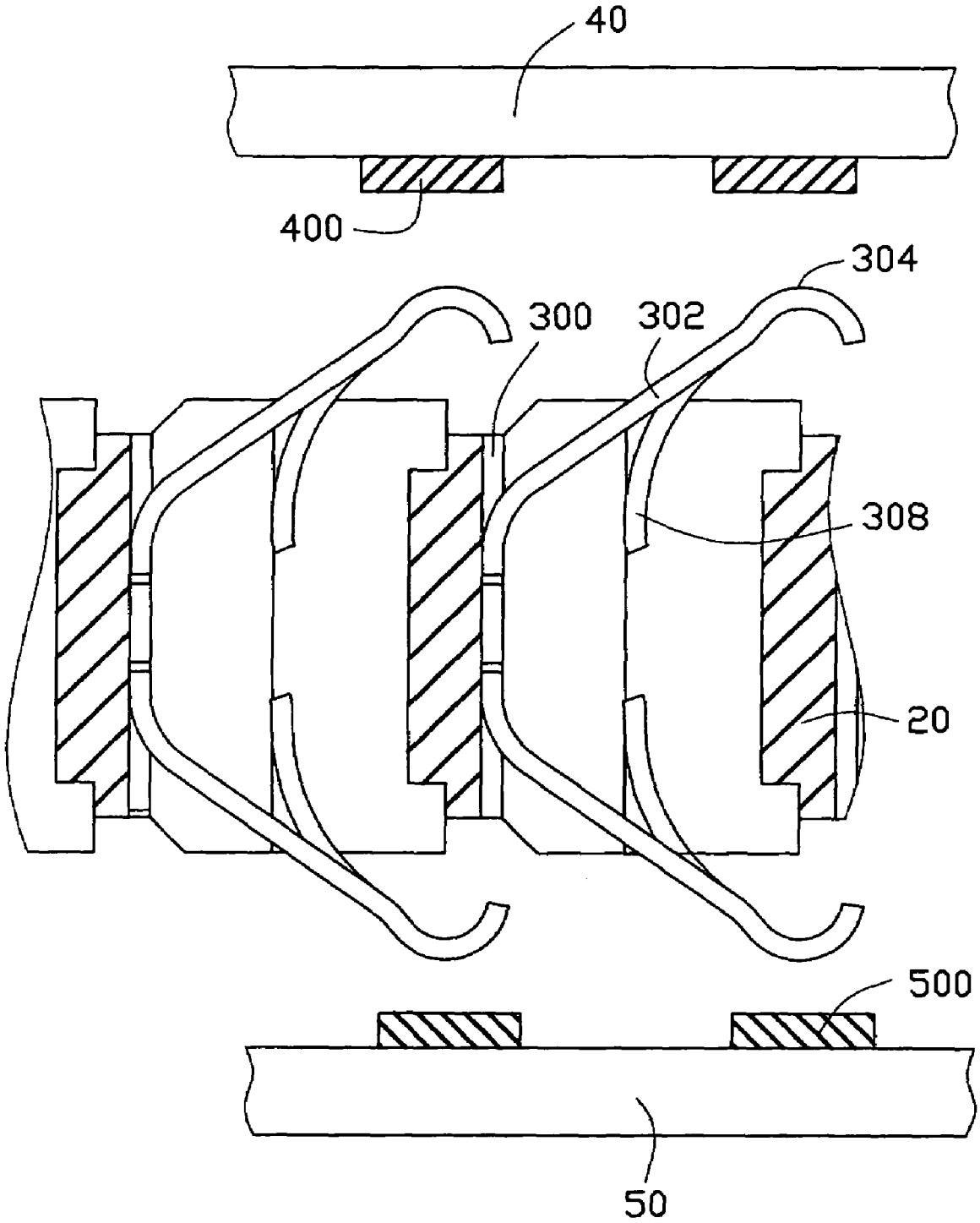
FIG. 4 illustrates an exemplary cross-sectional view of the land grid array socket of FIG. 2 sandwiched between two electrical interfaces, wherein the conductive terminals have not been in electrical engagement with the electrical interfaces.
Figure 5:
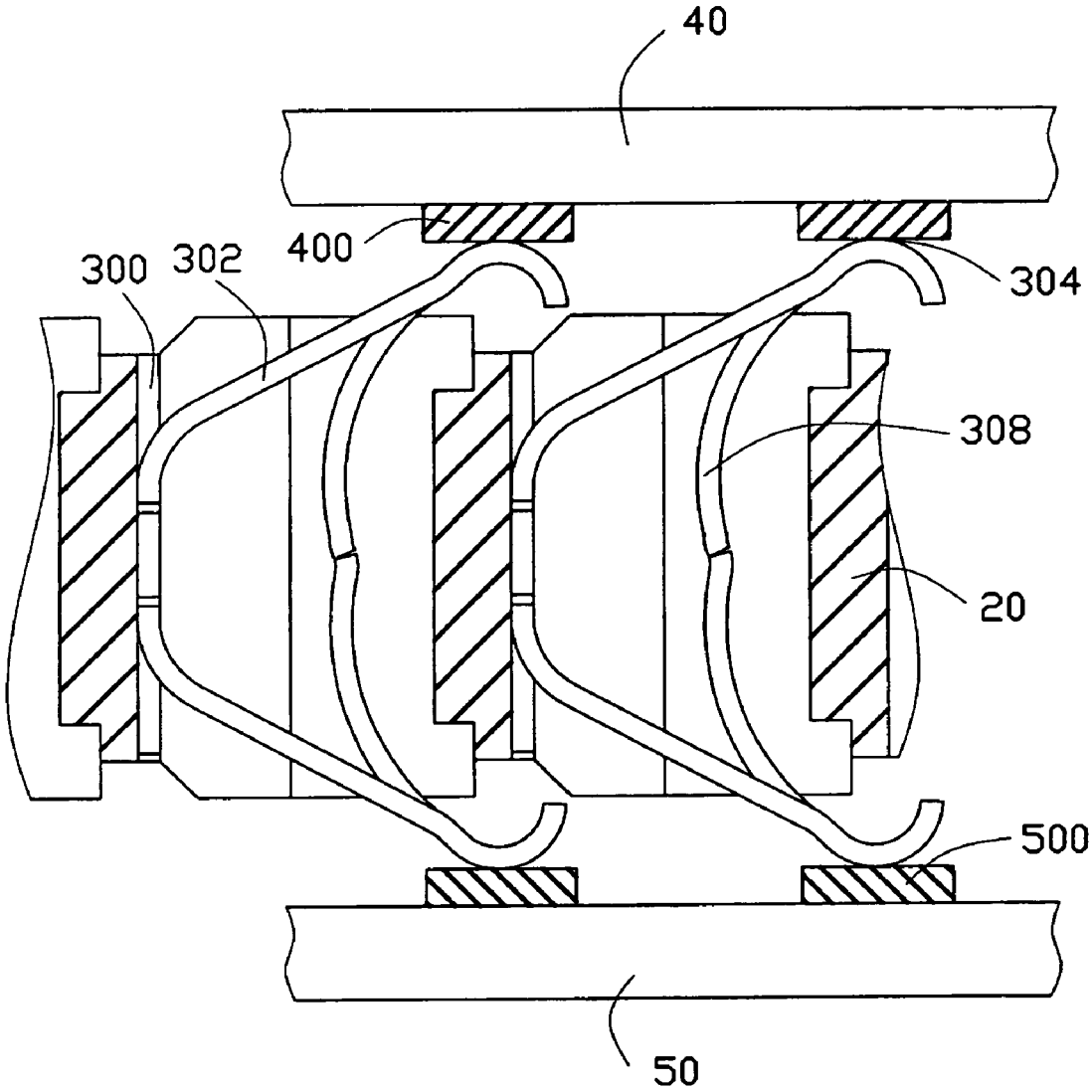
FIG. 5 is similar to FIG. 4, illustrating an exemplary cross-sectional view of the land grid array socket of FIG. 2 sandwiched between two electrical interfaces, wherein the conductive terminal have been brought to contact with the electrical interfaces.

Individual elements of the land grid array socket 10 will now be described in detail. As shown in FIG. 1, FIG. 4 and FIG. 5, the housing 20 includes an upper surface 202 facing the package 40, a lower surface 206 opposite to the circuit substrate 50, and a number of passages 204 arrayed in a predetermined fashion extending vertically between the upper surface 202 and the lower surface 206. Each passage 204 includes a narrow retaining slot 2040 and a wide receiving slot 2042 in communication with each other.

As best shown in FIG. 3, the conductive terminal 30 is generally formed by stamping and bending a metal sheet. The terminal 30 includes an H-shaped base section 300 and a pair of opposing resilient arms 302 projecting obliquely from upper and lower sides of the base section 300. The resilient arms 302 are symmetrically disposed with respect to the base section 300 and each define a convex contacting section (not labeled) at a free end thereof. The contacting section is configured to have multiple discrete contacting points 304 via a through-hole 306 at a center thereof. In an alternative form of the present embodiment, the contacting section could also be profiled to have multiple contacting points 304 via a recess at a center thereof.

The resilient arms 302 each includes a cantilevered rib 308 extending toward each other. The ribs 308 are integrally formed with the resilient arms 302 via punching or other processes known to one ordinary skilled in the art. The ribs 308 can mate with each other under compression of two electrical interfaces, such as a land grid array package 40 and a circuit substrate 50, so as to form a short electrical path between the package 40 and the circuit substrate 50. Each of the resilient arms 302 defining an opening 303. The rib 308 in fact extends from an edge of the opening 303. The opening 303 serves also as a receiving space for the rib 308 if the ribs 308 abut against each other and undergo some deformation.

Referring to FIG. 2, FIG. 4 and FIG. 5, when the terminal 30 is inserted in the passages 204, the base section 300 of the terminal 30 is secured in the narrow slot 2040. The resilient arms 302 protruding obliquely beyond the housing 20 from upper and lower sides of the base sections 300, so as to electrically register with a conductive pad 400 on the land grid array package 40 and a conductive member 500 on the circuit substrate 50, respectively.

In connection with the preceding description, the conductive terminal 30 in accordance with the embodiment of the present invention can provide multiple contacting points 304 to mate with a land grid array package 40 or a circuit substrate 50 attached thereto, thereby ensuring reliable electrical connection between the conductive terminal 30 and the land grid array package 40 even in the presence of deflection of the terminal 30.

Referring particularly to FIG. 4 and FIG. 5, prior to being sandwiched between a land grid array package 40 and a circuit substrate 50, the resilient arm 302 of the terminal 30 is at a natural state, with the ribs 308 thereof spaced from each other. When the resilient arm 302 is fully compressed down by the land grid array package 40, the ribs 308 of the terminal 30 mate with one another. The signal is transmitted through path of the upper contacting points 304, the ribs 308 and the lower contacting points 304 of the terminal 30 successively. Or in other words, the arrangement of the ribs 308 can offer a short electrical path between the package 40 and the circuit substrate 50.

While the present invention has been illustrated by description of embodiment thereof, and while the embodiment have been described in considerable detail, it is not intended to restrict or in any way limit the scope of the appended claims to such details. Additional advantages and modifications in the spirit and scope of the present invention will readily appear to one skilled in the art. Therefore, the present invention is not limited to the specific details and illustrative examples shown and described.

The invention claimed is:

1. A land grid array socket comprising:

a dielectric housing defining a plurality of passages arranged in a predetermined fashion;

and a plurality of conductive terminals residing in corresponding passages, respectively, each terminal comprising a vertical base section seated in the passage and a pair of opposing resilient arms extending straightforward and obliquely beyond the housing from upper and lower sides of the base section, each resilient arm defining multiple convex contacting points at a distal end thereof to form reliable electrical connection with an electronic component coupled thereto; and wherein each conductive terminal includes a pair of secondary resilient arms each extending as one piece from the resilient arms and mated with each other when the resilient arms are depressed, each resilient arm defining a through opening with the secondary resilient arm extending from one edge of said opening.

2. The land grid array socket of claim 1, wherein each resilient arm of the terminal has a recess at a free end thereof to define two spaced contacting points.

3. The land grid array socket of claim 1, wherein each resilient arm of the terminal has a through-hole at a free end thereof to define two spaced contacting points.

4. The land grid array socket of claim 1, wherein the secondary arms extending toward each other to form a short electrical path under compression of the electronic component.

5. The land grid array socket of claim 1, wherein each passage in the housing comprises a narrow retaining slot and a wide receiving slot in communication with each other, the base section of the terminal is secured in the narrow retaining slot, and the resilient arms of the terminal extend to and reside in the wide receiving slot.

6. The land grid array socket of claim 1, wherein the base section of the terminal has an H-shaped configuration.

7. The land grid array socket of claim 1, wherein the resilient arms of the terminal are symmetrically arranged with respect to the base section.

8. An electrical connector for establishing electrical connection between two electrical interfaces, the electrical connector comprising:

a dielectric housing defining a plurality of passages extending vertically therein; and a plurality of conductive terminals disposed in corresponding passages, respectively, each terminal having a vertical base section secured in the passage and a pair of opposing resilient arms extending straightforward and obliquely from upper and lower sides of the base section for electrical engagement with the interfaces, the resilient arms each integrally disposed with a rib stretching out toward each other, each rib extending as one piece from the resilient arm, and under compression of the electrical interfaces the ribs mating with each other to form a short electrical path between the electrical interfaces, the resilient arms each defining a through opening corresponding to the rib, the rib extending from one edge of said opening and the rib being received in the opening after distortion of the rib when the ribs abut against each other.

9. The electrical connector of claim 8, wherein the base section of the terminal has an H-shaped configuration.

10. The electrical connector of claim 8, wherein the resilient arms of the terminal are symmetrically arranged with respect to the base section.

11. The electrical connector of claim 8, wherein each resilient arm of the terminal is formed with a convex contacting section at an end thereof.

12. The electrical connector of claim 11, wherein the contacting section of the terminal comprises a through-hole at a center thereof to define two spaced contacting points.

13. The electrical connector of claim 11, wherein the contacting section of the terminal comprises a recess at a center thereof to define two spaced contacting points.

14. An electrical connector comprising:

an insulative housing defining opposite upper and lower faces thereon and a plurality of passageways therein between the upper and lower faces;

a plurality of contacts disposed in the corresponding passageways, respectively;

each of the contacts defining a symmetrical structure including a vertical retention base with opposite upper and lower spring arms respectively extending therefrom upward and downwardly, each of said upper and lower spring arms defining a contacting region at a distal tip, each of said upper and lower spring arms further defining a through opening with a rib extending from one edge of said opening, the rib and the spring arms being formed as a one piece structure; wherein each rib extends oppositely with regard to the corresponding contacting region, and the ribs of said upper and lower spring arms engage each other when the upper and lower spring arms moves toward each other.

* * * * *